US008109791B2

(12) United States Patent
Kameyama et al.

(10) Patent No.: US 8,109,791 B2
(45) Date of Patent: Feb. 7, 2012

(54) SHIELD CONNECTOR

(75) Inventors: Isao Kameyama, Shizuoka (JP); Motoo Nojima, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/320,515

(22) Filed: Jan. 28, 2009

(65) Prior Publication Data

US 2009/0209130 A1 Aug. 20, 2009

(30) Foreign Application Priority Data

Feb. 15, 2008 (JP) ..... 2008-034612

(51) Int. Cl.
*H01R 13/658* (2006.01)

(52) U.S. Cl. ..... 439/607.37

(58) Field of Classification Search ..... 439/607.37, 439/607.01, 607.07, 607.09, 607.27, 660, 439/260

See application file for complete search history.

(56) References Cited

U.S. PATENT DOCUMENTS

| | | | | |
|---|---|---|---|---|
| 6,280,252 | B1 * | 8/2001 | Huang | 439/607.48 |
| 6,315,608 | B1 * | 11/2001 | Lopata et al. | 439/607.36 |
| 7,654,866 | B2 * | 2/2010 | He et al. | 439/607.01 |
| 2004/0157491 | A1 * | 8/2004 | Lin | 439/607 |
| 2008/0038951 | A1 * | 2/2008 | He et al. | 439/260 |

FOREIGN PATENT DOCUMENTS

| | | |
|---|---|---|
| JP | 11-026092 | 1/1999 |
| JP | 2000-280102 | 10/2000 |
| JP | 2005-294260 | 10/2005 |

* cited by examiner

*Primary Examiner* — Alexander Gilman
(74) *Attorney, Agent, or Firm* — Edwards Wildman Palmer LLP

(57) ABSTRACT

A shield connector is provided, by which an electric shield can be securely performed. The shield connector includes: a plurality of terminal fittings; a housing holding the plurality of the terminal fittings; an electrically conductive inner shield shell receiving the housing; and an electrically conductive outer shield shell receiving the inner shield shell, wherein the outer shield shell includes: a square tube-shaped shell body; and surface-fixing parts, each of which is formed projecting from a peripheral wall of the shell body toward the inside of the shell body and has a parallel wall, which is formed parallel to the peripheral wall and placed closely on an outer surface of the inner shield shell.

3 Claims, 6 Drawing Sheets

SHIELD CONNECTOR

BACKGROUND OF THE INVENTION (1) Field of the Invention

The present invention relates to a shield connector to be used when electronic instruments mounted, for example, on a motor vehicle are electrically connected with each other.

(2) Description of the Related Art

Various electronic instruments are mounted on a motor vehicle as a mobile unit. Therefore, the motor vehicle is provided with a wiring harness for transmitting electric power and signals to the electronic instruments. The wiring harness includes a plurality of electric wires and connectors.

The electric wire is so-called a coated electric wire which includes an electrically conductive core wire and a coating, which is made of electrically insulating synthetic resin and coats the core wire. So far, various shield connectors 100 (shown in FIG. 8 as an example) have been used as the connector described above.

The shield connector 100 shown in FIG. 8 is placed on and fixed to a printed circuit board. The shield connector 100 includes an inner housing 101 made of electrically insulating synthetic resin, a terminal fitting 102 attached to the inner housing 101, an inner shield shell 103 made of metal, an outer housing 104 made of electrically insulating synthetic resin, and an outer shield shell 105 made of metal.

The inner housing 101 is formed in a shape of a square tube having one closed end. The terminal fitting 102 is made of metal and formed in a bar-shape. One end part of the terminal fitting 102 is received in the inner housing 101, while another end part thereof is bent at right angles from the one end part and arranged outside the inner housing 101.

The inner shield shell 103 is formed by bending a sheet metal. The inner shield shell 103 receives the inner housing 102 therein and integrally includes: a shell body 106, an inner surface of which is closely placed on an outer surface of the inner housing 102; and a fixing piece 107 which rises up from the shell body 106 and fixed to a conductor pattern of a printed circuit board.

The outer housing 104 is formed in a square tube-shape receiving the inner housing 101 and the inner shield shell 103 therein. The outer shield shell 105 is formed by bending a sheet metal. The outer shield shell 105 receives the outer housing 104 therein and integrally includes: a shell body 108, an inner surface of which is closely placed on an outer surface of the outer housing 104; and a resilient contacting piece 109 which rises up from the shell body 108 inwardly and resiliently comes in contact with the inner shield shell 103.

The shield connector 100 is coupled with a mating connector and guides an electric noise to be leaked to the outside from the terminal fitting 102 and an electric noise to enter the terminal fitting 102 from the outside to a ground circuit by way of the shield shell 103, the outer housing 104, the fixing piece 107 of the shield shell 103, and the conductor pattern of the printed circuit board.

Since the conventional shield connector 100 shown in FIG. 8 includes the inner housing 101 and the outer housing 104, which are covered by the shield shell 103 and the shield shell 105, respectively, therefore as shown in FIG. 9, a gap takes place between the housings 101 and 104, resulting in that a shielding characteristic is hardly secured with the shield shells 103 and 105. That is, the electric noise is hardly prevented from entering the terminal fitting 102 and the electric noise is hardly prevented from leaking from the terminal fitting 102.

Moreover, the outer shield shell 105 is provided with the resilient contacting piece 109 which comes in contact with the inner shield shell 103 and electrically connects the shield shells 103 and 105 to each other. Therefore, the housings 101 and 104 vibrate relatively to each other by vibration of a traveling motor vehicle, resulting in that a contact between the resilient contacting piece 109 and the inner shield shell 103 becomes unstable.

SUMMARY OF THE INVENTION

It is therefore an objective of the present invention to solve the above problems and to provide a shield connector which can securely perform an electric shield.

In order to attain the above objective, the present invention is to provide a shield connector including:

a plurality of terminal fittings;

a housing holding the plurality of the terminal fittings;

an electrically conductive inner shield shell receiving the housing; and an electrically conductive outer shield shell receiving the inner shield shell, wherein the outer shield shell includes: a square tube-shaped shell body; and surface-fixing parts, each of which is formed projecting from a peripheral wall of the shell body toward the inside of the shell body and has a parallel wall, which is formed parallel to the peripheral wall and is placed closely on (i.e. closely comes in contact with) an outer surface of the inner shield shell.

With the construction described above, since the outer shield shell is provided with surface-fixing parts, each of which is formed projecting from a peripheral wall of the shell body toward the inside of the shell body and placed closely on an outer surface of the inner shield shell, therefore the outer shield shell can be fixed without using an outer housing.

Since the outer shield shell can be fixed without using an outer housing, therefore a gap between the inner shield shell and the outer shield shell can be prevented from occurring. Therefore, the terminal fittings existing in the housing can be securely electrically shielded from the outside. Further, since the outer shield shell is provided with the surface-fixing parts, therefore when the shield connector is mounted on a motor vehicle, even if vibration during travelling of the motor vehicle takes place, the surface-fixing parts come in close contact with the outer surfaces of the inner shield shell, so that the inner shield shell and the outer shield shell can be securely electrically connected to each other.

The shield connector further includes fixing parts each fixing the surface-fixing part of the outer shield shell and a portion of the inner shield shell, which portion is placed on (i.e. closely comes in contact with) the surface-fixing part of the outer shield shell, to each other.

With the construction described above, since the shield connector further includes the fixing parts, the surface-fixing part of the outer shield shell and the inner shield shell can be securely fixed to each other, that is, the outer shield shell and the inner shield shell can be securely fixed to each other. Therefore, when the shield connector is mounted on a motor vehicle, even if vibration during travelling of the motor vehicle takes place, the surface-fixing part comes in close contact with an outer surface of the inner shield shell, so that the inner shield shell and the outer shield shell can be further securely electrically connected to each other.

The shell body is placed on a printed wiring board so that the outer shield shell is fixed to the printed wiring board, wherein the shell body is provided with a notch formed ranging from an end in a longitudinal direction of a peripheral wall of the shell body to a center of the peripheral wall, said peripheral wall being placed on the printed wiring board, wherein facing surfaces of inner edges of the notch, which face each other in a width direction of the shell body having a distance therebetween, extend along a longitudinal direction of the shell body, wherein the inner shield shell includes a pair of fixing pieces to be fixed to the printed wiring board and the fixing pieces are placed closely on (i.e. closely come in contact with) the respective facing surfaces.

With the construction described above, since the fixing pieces of the inner shield shell are placed closely on the respective facing surfaces of the outer shield shell, therefore the fixing pieces can be prevented from being displaced after being fixed to the printed wiring board, so that electrical connection between the shield connector and the printed wiring board can be prevented from being unstable.

DESCRIPTION OF THE PREFERRED EMBODIMENTS

Figure 1:
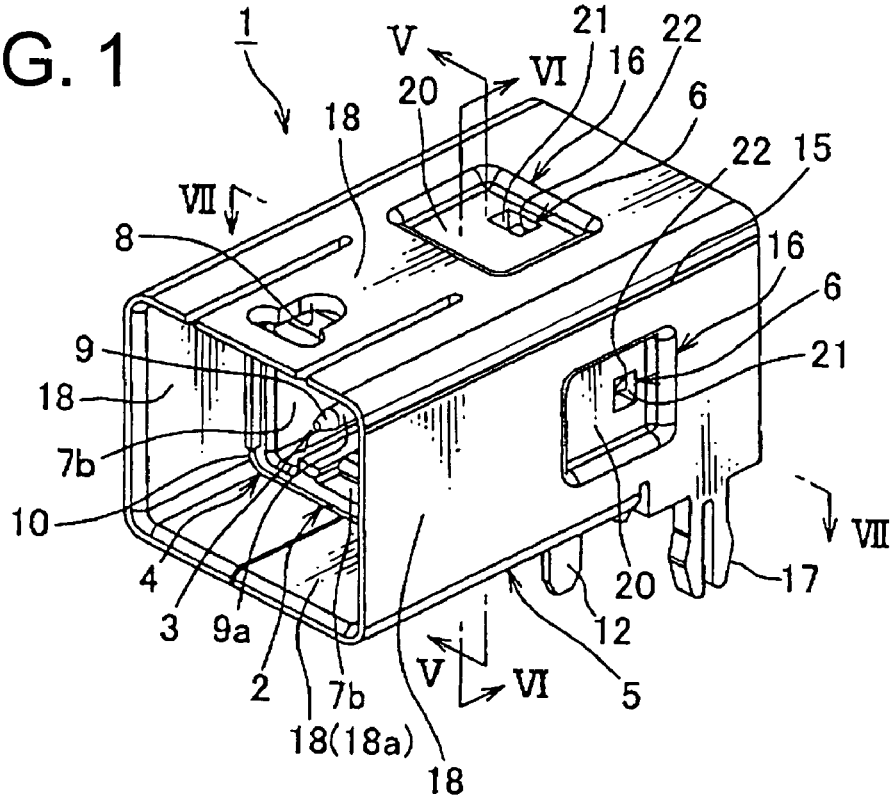
FIG. 1 is a perspective view illustrating a shield connector according to a preferred embodiment of the present invention.
Figure 2:
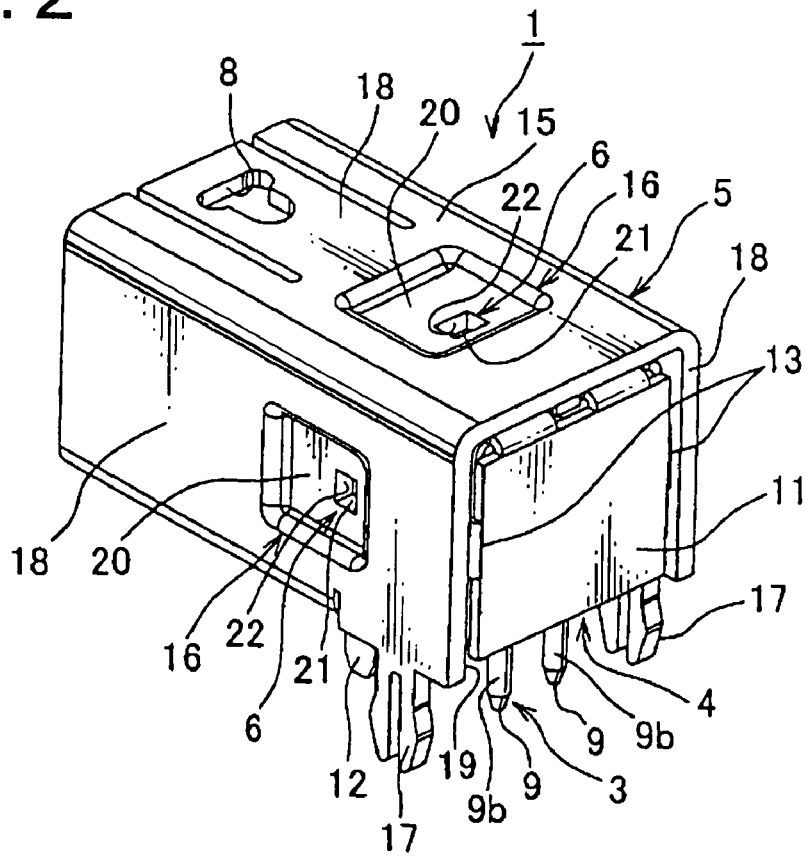
FIG. 2 is a perspective view viewed from the back of the shield connector shown in FIG. 1.

In the following, a shield connector according to a preferred embodiment of the present invention will be explained with reference to FIGS. 1-7. The shield connector 1 is attached to a printed wiring board (not shown in the figure) and fitted to a mating connector (not shown in the figure) of a wiring harness, thereby being mounted on a motor vehicle. The shield connector 1 supplies signals and electric power to various electronic instruments mounted on the motor vehicle.

The printed wiring board, to which the shield connector 1 is attached, includes a board made of electrically insulating synthetic resin and a circuit pattern (not shown in the figure) formed on the board. The board is formed in a flat plate-shape. Various electronic instruments (not shown in the figure) are mounted on the board. The circuit pattern is made of metal such as copper, formed in a foil-shape (film-shape), and stuck onto (printed on) a surface of the board. The circuit pattern electrically connects the electronic instruments mounted on the board to each other according to a predetermined pattern. The circuit pattern is electrically connected to a ground circuit of the motor vehicle.

As shown in FIGS. 1-3 and 5, the shield connector 1 includes a housing 2, a set 3 of terminal fittings, an inner shield shell 4, an outer shield shell 5, and a fixing part 6.

Figure 5:
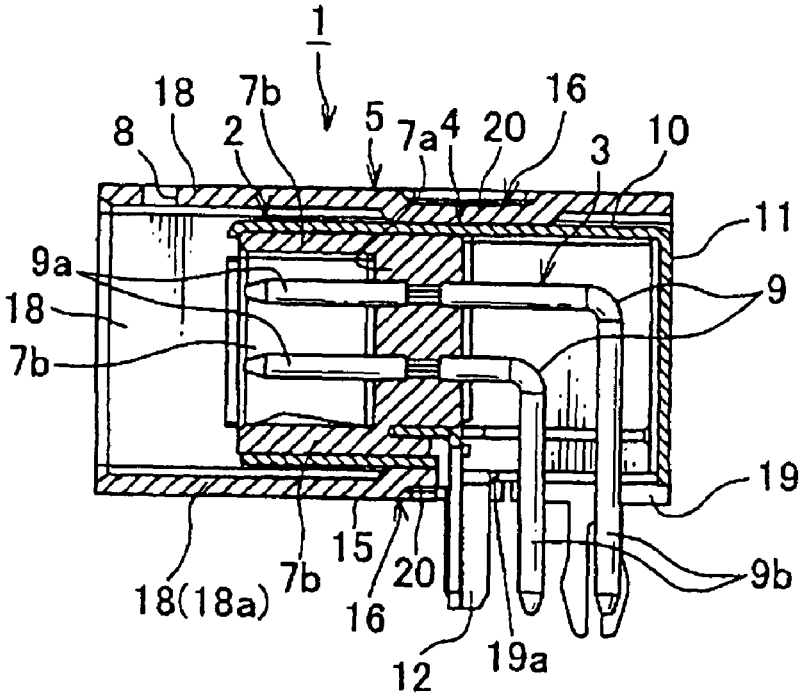
FIG. 5 is a cross sectional view taken along V-V line in FIG. 1.
Figure 6:
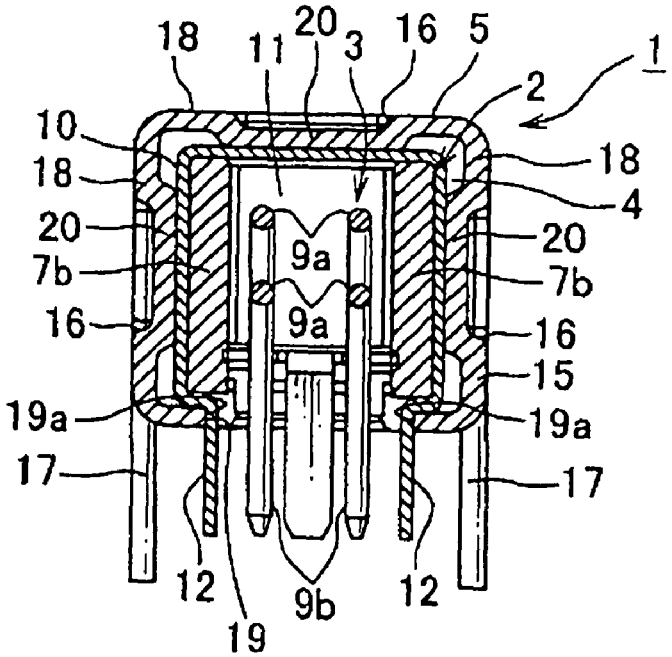
FIG. 6 is a cross sectional view taken along VI-VI line in FIG. 1.

The housing 2 is made of electrically insulating synthetic resin and as shown in FIGS. 5 and 6, one end of the housing 2 is closed by a wall 7*a* and formed in a square tube-shape by peripheral walls 7*b* continuing to each other. The housing 2 is provided with a locking hole 8, into which a locking arm or the like of a mating connector fits, in the vicinity of an opening situated on this side of the housing 2 in FIG. 1.

As shown in FIG. 6, the set 3 of the terminal fittings includes a plurality of terminals 9. Each terminal fitting 9 is made of metal and formed in a bar-shape. Each terminal fitting 9 is formed in a round bar-shape bent in an L-shape viewed from the side. The terminal fittings 9 are arranged in parallel to each other. One end part 9*a* of the terminal fitting 9 penetrates through the wall 7*a* and is received in the housing 2, so that the terminal fittings 9 are held by the housing 2. An opposite end part 9*b* of the terminal fitting 9 extends toward the outside of the housing 2. The opposite end part 9*b* of terminal fitting 9 is fixed to the circuit pattern of the printed wiring board by brazing using solder or the like.

Figure 4:
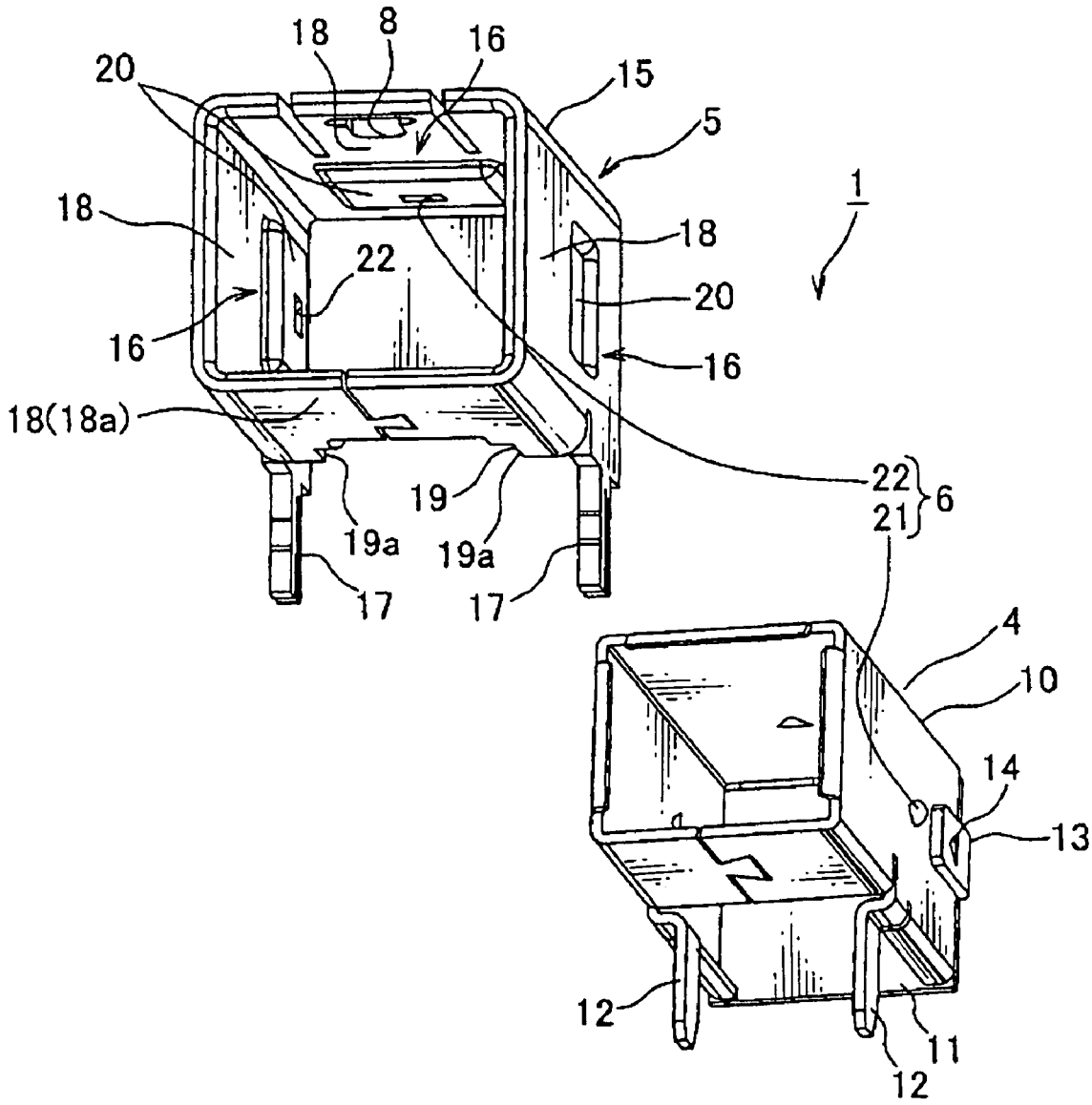
FIG. 4 is a perspective view of shield shells of the shield connector shown in FIG. 1.

The inner shield shell 4 is formed in a square tube-shape by bending an electrically conductive sheet metal. As shown in FIG. 4, the inner shield shell 4 integrally includes a square tube-shaped shell body 10, a back shell 11, and a pair of fixing pieces 12. The shell body 10 is formed in a square tube-shape and placed on outer surfaces of the peripheral walls 7*b* of the housing 2, so that the shell body 10 receives the housing 2.

Figure 7:
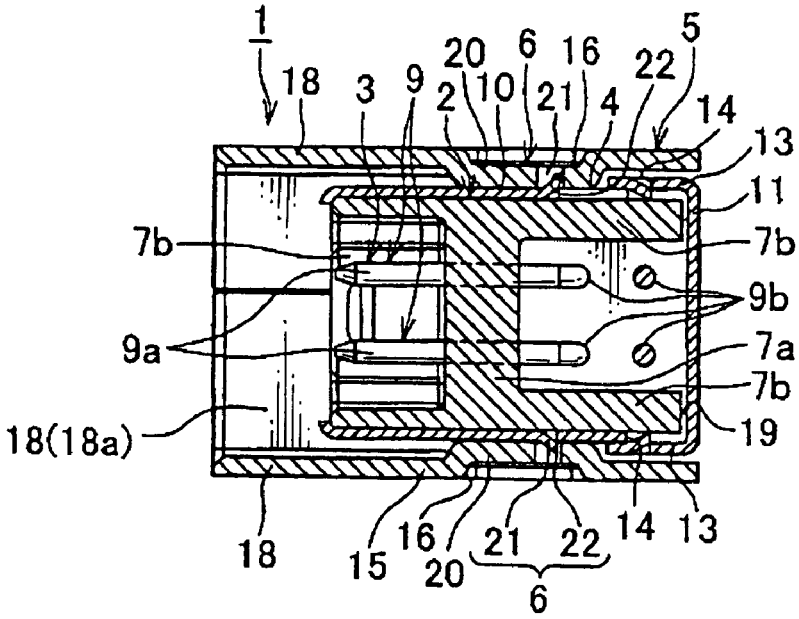
FIG. 7 is a cross sectional view taken along VII-VII line in FIG. 1.
Figure 8:
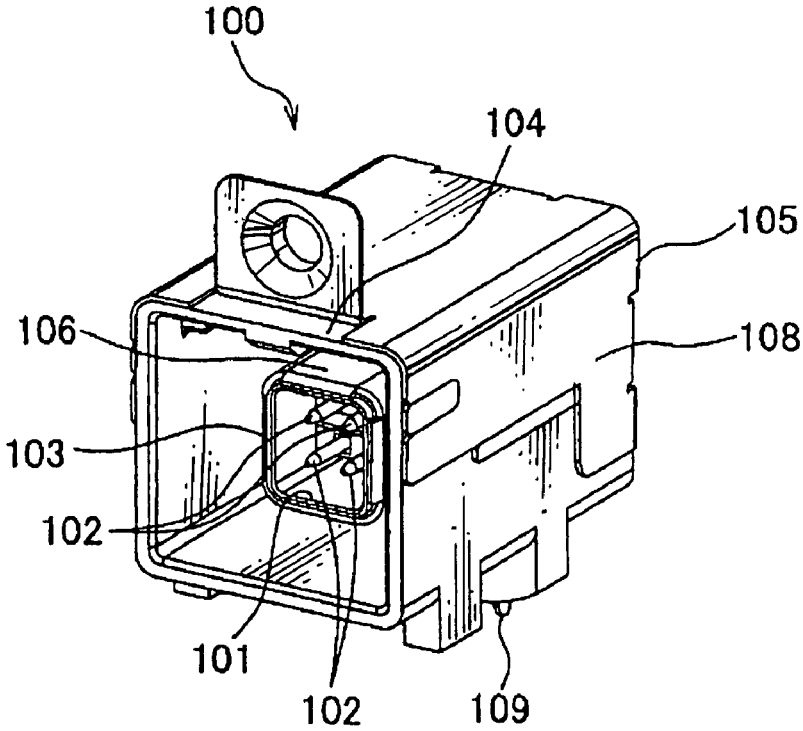
FIG. 8 PRIOR ART
FIG. 8 is a perspective view of a conventional shield connector.
Figure 9:
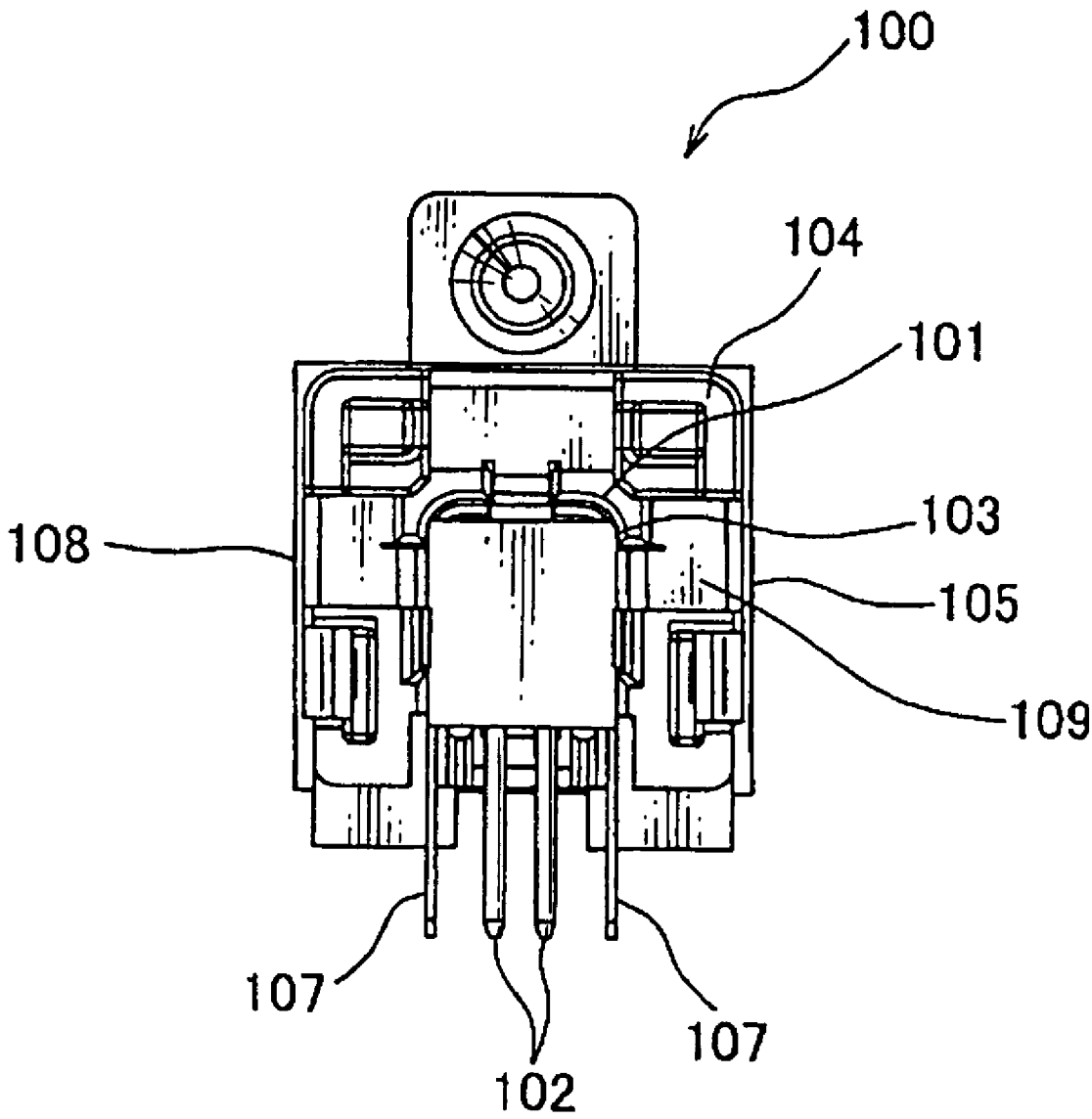
FIG. 9 PRIOR ART
FIG. 9 is a plan view illustrating a plane of the shield connector shown in FIG. 8.

The back shell 11 is formed in a flat plate-shape. The back shell 11 is formed by bending from the shell body 10 so as to continue to an end of the shell body 10 and to be parallel to the wall 7*a*. The opposite end part 9*b* of the terminal fitting 9 is positioned between the back shell 11 and the wall 7*a*. As shown in FIG. 7, the shell body 10 and the back shell 11 are provided with a fixing piece 13 and a fixing hole 14, respectively, so as to fix the shell body 10 and the back shell 11 to each other.

The fixing pieces 12 are arranged in parallel to each other in a width direction of the housing 2 having a distance therebetween on a condition that the inner shield shell 4 covers the housing 2. The pair of the fixing pieces 12 rises up from the shell body 10 toward the outside of the shell body 10. The pair of the fixing pieces 12 is fixed to the circuit pattern of the printed wiring board by brazing using solder or the like. The pair of the fixing pieces 12 is placed closely on (i.e. closely comes in contact with) respective facing surfaces 19*a* (explained later).

The outer shield shell 5 is formed in a square tube-shape by bending an electrically conductive sheet metal. As shown in FIG. 4, the outer shield shell 5 integrally includes a square tube-shaped shell body 15, a plurality of surface-fixing parts 16, and a pair of fixing pieces 17.

The shell body 15 includes a plurality of peripheral walls 18 (four walls 18 in an example shown in the figure) continuing to each other and is formed in a square tube-shape. The shell body 15 receives the inner shield shell 4 therein on a condition that the peripheral walls 18 are in parallel to the shell body 10 of the inner shield shell 4. One peripheral wall 18 (hereinafter, indicated by 18*a*) of the shell body 15 is placed on the printed wiring board, so that the shell body 15 is fixed to the printed wiring board.

Figure 3:
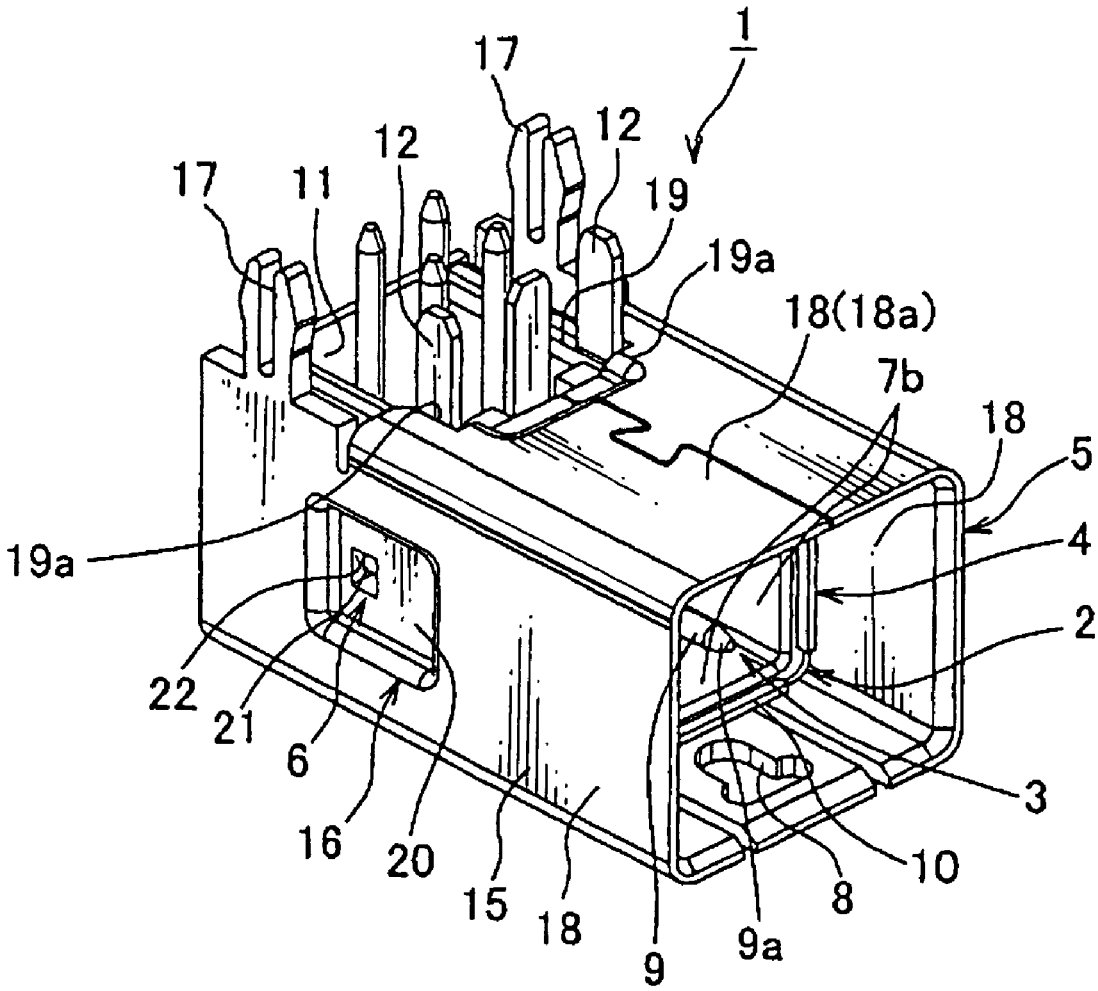
FIG. 3 is a perspective view viewed from the bottom of the shield connector shown in FIG. 1.

As shown in FIG. 3, this one peripheral wall 18*a* is provided with a notch 19. The notch 19 is formed ranging from an end of the peripheral wall 18*a* on the side situated away from a mating connector (i.e. an end of the peripheral wall 18*a* situated in the vicinity of the opposite end part 9*b* of the terminal fitting 9) to a center of the peripheral wall 18*a* in a longitudinal direction of the peripheral wall 18*a*. As shown in FIG. 4, an inner edge of the notch 19 is provided with a pair of facing surfaces 19*a* extending straight along the longitudinal direction of the shell body 15. The facing surfaces 19*a* are arranged in parallel to each other in the width direction of the shell body 15 having a distance between the facing surfaces 19*a*.

The surface-fixing part 16 is provided on the corresponding peripheral wall 18 and not provided on the peripheral wall 18*a*. In an example shown in the figure, one surface-fixing part 16 is provided on one peripheral wall 18. The surface-fixing part 16 is formed projecting from a central part of the peripheral wall 18 toward the inside of the shell body 15. As shown in FIGS. 5-7, the surface-fixing part 16 is formed in parallel to the peripheral wall 18 and has a parallel wall 20 which is placed closely on (i.e. closely comes in contact with) an outer surface of the shell body 10 of the inner shield shell 4. The parallel walls 20 are placed closely on (i.e. closely come in contact with) the respective outer surfaces of the shell body 10 of the inner shield shell 4, so that the surface-fixing parts 16 position the inner shield shell 4 and the outer shield shell 5 and electrically connect the inner shield shell 4 and the outer shield shell 5 to each other.

The pair of the fixing pieces 17 rises up from both ends in the width direction of the one peripheral wall 18*a* (i.e. from both ends in the width direction of the notch 19) and is arranged in parallel to each other having a distance therebetween. The pair of the fixing pieces 17 rises up from the shell body 15 outside the shell body 15. The pair of the fixing pieces 17 is fixed to the circuit pattern of the printed wiring board by brazing using solder or the like.

The fixing part 6 includes: a fixing projection 21 formed on one of the surface-fixing part 16 of the outer shield shell 5 and a portion of the inner shield shell 4 on which portion the surface-fixing part 16 is placed closely (in an example shown in the figure, the fixing projection 21 being formed on the portion of the inner shield shell 4 on which portion the surface-fixing part 16 is placed closely); and a fixing hole 22 formed on another of the surface-fixing part 16 of the outer shield shell 5 and a portion of the inner shield shell 4 on which portion the surface-fixing part 16 is placed closely (in the example shown in the figure, the fixing hole 22 being formed on the surface-fixing part 16 of the outer shield shell 5). The fixing projection 21 is formed by raising a part of the portion of the inner shield shell 4, on which portion the surface-fixing part 16 is placed closely, toward the outside of the inner shield shell 4. The fixing hole 22 is provided at a position of the fixing projection 21 and penetrates through the parallel wall 20 of the surface-fixing part 16. The fixing projection 21 enters the fixing hole 22 and is locked in the fixing hole 22, so that the fixing part 6 fixes the surface-fixing part 16 of the outer shield shell 5 and the portion of the inner shield shell 4, on which portion the surface-fixing part 16 is placed closely, to each other.

The shield connector 1 having the structure described above is assembled as follows. First, each terminal fitting 9 is attached to the housing 2, and each fixing piece 13 and the corresponding fixing hole 14 of the inner shield shell 4 are fixed to each other. Then, an end part of the shell body 10 of the inner shield shell 4, said end part being situated away from the back shell 11, is allowed to approach the opposite end part 9*b*-side of the terminal fitting 9 of the housing 2 so as to insert the housing 2 into the shell body 10 of the inner shield shell 4. Then, the inner shield shell 4 is positioned with respect to the housing 2 on a condition that the shell body 10 is matched with the whole outer surfaces of the housing 2 and the back shell 11 is situated having a distance from the opposite end part 9*b* of the terminal fitting 9.

Then, an end part of the inner shield shell 4, said end part being situated away from the back shell 11, is inserted into the shell body 10 from an end part of the shell body 15 of the outer shield shell 5, said end part being provided with the notch 19. At that time, the opposite end part 9*b* of the terminal fitting 9 is positioned in the notch 19. then, the parallel wall 20 of the surface-fixing part 16 is placed closely on (i.e. closely comes in contact with) an outer surface of the shell body 10 of the inner shield shell 4 and the pair of the fixing pieces 12 of the inner shield shell 4 is placed closely on (i.e. closely comes in contact with) the facing surface 19*a*. Then, the fixing projection 21 of the fixing part 6 is allowed to enter the fixing hole 22 and locked in the fixing hole 22, and the outer shield shell 5 and the inner shield shell 4 are fixed to each other, thereby assembling the shield connector 1. Thus assembled shield connector 1 is placed on the printed wiring board, and the opposite end part 9*b* of the terminal fitting 9 and the fixing pieces 12 are electrically connected to the circuit pattern of the printed wiring board.

According to the preferred embodiment described above, since the outer shield shell 5 is provided with surface-fixing parts 16, each of which is formed projecting from a peripheral wall 18 of the shell body 15 toward the inside of the shell body 15 and has a parallel wall 20, which is placed closely on (i.e. closely comes in contact with) an outer surface of the inner shield shell 4, therefore the outer shield shell 5 can be fixed without using an outer housing. Therefore, a gap between the inner shield shell 4 and the outer shield shell 5 can be prevented from occurring. Therefore, the terminal fittings 9 existing in the housing 2 can be securely electrically shielded from the outside.

Further, since the outer shield shell 5 is provided with surface-fixing parts 16, each of which has a parallel wall 20, which is placed closely on (i.e. closely comes in contact with) an outer surface of the shell body 10 of the inner shield shell 4, therefore when the shield connector 1 is mounted on a motor vehicle, even if vibration during travelling of the motor vehicle takes place, the surface-fixing parts 16 come in close contact with the outer surfaces of the inner shield shell 4, so that the inner shield shell 4 and the outer shield shell 5 can be securely electrically connected to each other.

Since the shield connector 1 further includes the fixing parts 6, the surface-fixing part 16 of the outer shield shell 5 and the inner shield shell 4 can be securely fixed to each other, that is, the outer shield shell 5 and the inner shield shell 4 can be securely fixed to each other. Therefore, when the shield connector 1 is mounted on a motor vehicle, even if vibration during travelling of the motor vehicle takes place, the surface-fixing part 16 comes in close contact with an outer surface of the inner shield shell 4, so that the inner shield shell 4 and the outer shield shell 5 can be further securely electrically connected to each other.

Since the fixing pieces 12 of the inner shield shell 4 are placed closely on (i.e. closely come in contact with) the respective facing surfaces 19*a* of the outer shield shell 5, therefore the fixing pieces 12 can be prevented from being displaced after being fixed to the printed wiring board, so that electrical connection between the shield connector 1 and the printed wiring board can be prevented from being unstable.

In the preferred embodiment described above, the fixing projection 21 is provided on a portion of the inner shied shell 4, on which portion the surface-fixing part 16 is placed closely, and the fixing hole 22 is provided in the surface-fixing part 16 of the outer shield shell 5. However, instead, in the present invention, the fixing projection 21 may be provided on the surface-fixing part 16 of the outer shield shell 5 and the fixing hole 22 may be provided in a portion of the inner shied shell 4, on which portion the surface-fixing part 16 is placed closely.

The aforementioned preferred embodiments are described to aid in understanding the present invention and variations may be made by one skilled in the art without departing from the spirit and scope of the present invention.

What is claimed is:

1. A shield connector comprising:

a plurality of terminal fittings;

a housing holding the plurality of the terminal fittings;

an electrically conductive inner shield shell receiving the housing; and an electrically conductive outer shield shell receiving the inner shield shell, wherein the outer shield shell includes:

a square tube-shaped shell body; and surface-fixing parts, each of which is formed projecting from a peripheral wall of the shell body toward the inside of the shell body and has a parallel wall, which is formed parallel to the peripheral wall and in direct abutting contact with an outer surface of the inner shield shell, so that the inner shield shell and the outer shield shell can be securely electrically connected to each other.

2. The shield connector according to claim 1 further comprising fixing parts each fixing the surface-fixing part of the outer shield shell and a portion of the inner shield shell, which portion is placed on the surface-fixing part of the outer shield shell, to each other.

3. The shield connector according to claim 1, wherein the shell body is placed on a printed wiring board so that the outer shield shell is fixed to the printed wiring board, wherein the shell body is provided with a notch formed ranging from an end in a longitudinal direction of a peripheral wall of the shell body to a center of the peripheral wall, said peripheral wall being placed on the printed wiring board, wherein facing surfaces of inner edges of the notch, which face each other in a width direction of the shell body having a distance therebetween, extend along a longitudinal direction of the shell body, and wherein the inner shield shell includes a pair of fixing pieces to be fixed to the printed wiring board and the fixing pieces are placed closely on the respective facing surfaces.

* * * * *